US005347673A

United States Patent [19]

Nickels, Jr.

[11] Patent Number: 5,347,673

[45] Date of Patent: Sep. 20, 1994

[54] QUICK CHANGE PAD ASSEMBLY FOR ORBITAL POLISHER

[75] Inventor: Richard C. Nickels, Jr., Hampstead, Md.

[73] Assignee: Black & Decker Inc., Newark, Del.

[21] Appl. No.: 955,335

[22] Filed: Oct. 1, 1992

[51] Int. Cl.[5] ..... A47L 11/02

[52] U.S. Cl. ..... 15/97.1; 15/49.1; 403/20; 403/348; 51/177; 51/170 T; 29/426.6; 29/453

[58] Field of Search ..... 15/49.1, 50.1, 97.1, 15/98, 180; 51/170 T, 177; 29/426.6, 453; 248/222.1, , 222.3; 403/19, 20, 348, 321, 375

[56] References Cited

U.S. PATENT DOCUMENTS

| | | | |
|---|---|---|---|
| 650,272 | 5/1900 | Perry | 403/348 |
| 757,712 | 4/1904 | Arnold | 403/348 |
| 1,830,362 | 11/1931 | Johnson | 403/348 |
| 1,869,179 | 7/1932 | Yutzler et al. | 15/49.1 |
| 2,191,292 | 2/1940 | Spence | 403/19 |
| 2,561,279 | 7/1951 | Holt | 403/349 |
| 2,597,971 | 5/1952 | Burnham | 15/97.1 |
| 2,839,879 | 6/1958 | Eisenbeis | 51/195 |
| 2,873,131 | 2/1959 | Metrailer | 287/103 |
| 3,149,442 | 9/1964 | MacKay, Jr. et al. | 51/195 |
| 3,158,972 | 12/1964 | MacKay, Jr. et al. | 51/377 |
| 3,266,200 | 8/1966 | Block | 51/377 |
| 3,574,978 | 4/1971 | Block | 51/377 |
| 3,600,735 | 8/1971 | Jerabek | 403/348 |
| 3,875,607 | 4/1975 | Rosseau | 15/180 |
| 4,245,438 | 1/1981 | van Buren, Jr. | 51/377 |
| 4,391,548 | 7/1983 | Malish | 15/98 |
| 4,632,594 | 12/1986 | Del Tufo et al. | 403/322 |
| 4,648,737 | 3/1987 | Lake, Jr. et al. | 403/322 |
| 4,653,708 | 3/1987 | Rich | 248/27.1 |
| 4,662,024 | 5/1987 | Moench | 15/230.19 |
| 4,756,638 | 7/1988 | Neyret | 403/349 |
| 4,765,013 | 8/1988 | Lowe | 15/180 |
| 4,791,694 | 12/1988 | Itaya et al. | 15/97 R |
| 4,839,998 | 6/1989 | Block | 51/376 |
| 4,854,002 | 8/1989 | Smith | 15/180 |

FOREIGN PATENT DOCUMENTS

| | | | |
|---|---|---|---|
| 7217823 | 5/1972 | Fed. Rep. of Germany . | |
| 2512438 | 11/1975 | Fed. Rep. of Germany . | |
| 2619423 | 2/1989 | France | 403/321 |

*Primary Examiner*—David A. Scherbel
*Assistant Examiner*—Terrence R. Till
*Attorney, Agent, or Firm*—Harness, Dickey & Pierce

[57] ABSTRACT

A hand-held orbital polisher includes a manually actuatable coupling arrangement operating between a motor driven support platen and a polisher pad assembly having a backing platen connected to the support platen for rotation therewith. Respective pairs of manually actuatable shoulders are driven by a tool to simultaneously drive an array of coupling lugs on one of the platen into and locked engagement with the other platen.

17 Claims, 5 Drawing Sheets

QUICK CHANGE PAD ASSEMBLY FOR ORBITAL POLISHER

BACKGROUND OF THE INVENTION

The present invention relates to a quick connect/disconnect coupling arrangement for use in a handheld apparatus adapted to be employed for cleaning, waxing and/or polishing automobiles, vans, motor homes, airplanes, etc. For the purposes of convenience the apparatus will be referred to as a hand-held orbital polisher.

In a hand-held orbital polisher it is important that one polishing unit be readily removed and replaced by another so as to enable the machine to be used for different operations. It is also important that the change can be done quickly and that the coupling be capable of standing up to repeated changes.

A common type of coupling utilized includes a flat circular platen having a coaxial projection extending above the plate for driving connection to a vertical spindle and an annular plate member which includes a polishing pad and is secured to the platen by threaded fasteners. The spindle is offset to and driven by the vertical motor driven shaft of the machine, and unless the spindle is locked the platen is free wheeling.

It is known to provide interengaging lugs and lug receiving openings to couple a pair of plate members wherein the plate members are turned relative to one another so that the lugs of one plate member move behind a rear face of the other plate member to thereby prevent axial removal of the plate member relative to the flange.

This known type of coupling is quite effective but can have definite disadvantages. The coupling is designed relative to the direction of rotation of the shaft so that rotation tends to maintain the coupled relationship and the lugs are needed only to inhibit uncoupling. Unless the spacing of the lugs and ramps are very accurately formed, one or more of the ramps may be subject to a more severe wedging action so that a tight coupling is not possible. As a result, the connection may chatter and vibrate sufficiently to result in a poor finish on the surface and serious wear and damage within the machine. The high starting torque can cause the platen member to become so tightly wedged that when it is desired to change the polishing unit, it cannot be removed. Since the coupling is located between the polishing unit and the motor within the frame or housing of the machine, it is substantially impossible for the operator to apply the proper forces to the coupling to loosen it when it becomes wedged in this manner. Accordingly, a design utilizing interengaging lugs and ramps which obviates the above problems is described.

SUMMARY OF THE INVENTION

In an orbital polisher, there is provided drive and driven platens having interengaging lug and lug receiving openings disposed along first and second walls, the lugs extending from one of said platens for receipt in a respective opening of and rotatable relative to the other of the platens for coupling engagement therewith, and an improved coupling system for effecting engagement and disengagement of the lugs with the other platen. The coupling system comprises manually actuatable first cam means joined to the first and second walls for substantially simultaneously driving the lugs from an unengaged first position to an engaged second position, and manually actuatable second cam means joined to the first and second walls for substantially simultaneously driving the lugs from the engaged second position back to the unengaged first position.

Advantageously, the coupling systems herein are simple, and allow fast installation and removal of a surface treatment pad without spindle locking. Only a simple tool is required for operation and the use thereof substantially simultaneously operates to lock or unlock the pad unit.

Further objects, advantages and features of the present invention will become more fully apparent from the detailed consideration of the arrangement and construction of the constituent parts as set forth in the following description taken together with the accompanying drawings.

DETAILED DESCRIPTION OF THE PREFERRED EMBODIMENT

FIGS. 1–9 illustrate exemplary preferred embodiments of the present invention as applied to a quick change pad arrangement for an orbital polisher. One skilled in the art will readily recognize from the following discussion that such illustrative embodiments are exemplary and that the coupling arrangement of the invention is also applicable to other hand held apparatus.

Figure 1:
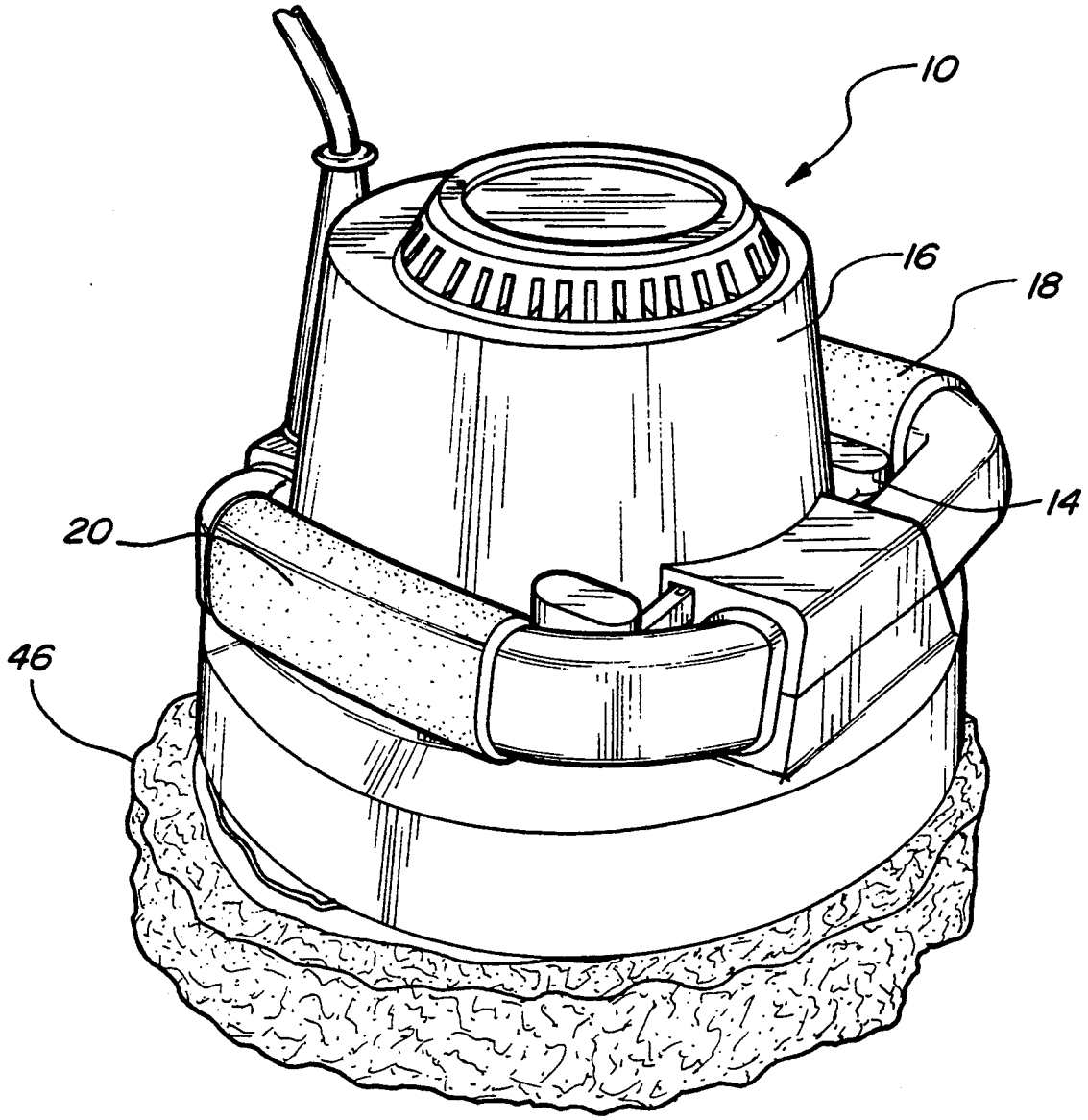
FIG. 1 is a perspective view of an orbital polisher having a quick change pad assembly according to the present invention.
Figure 2:
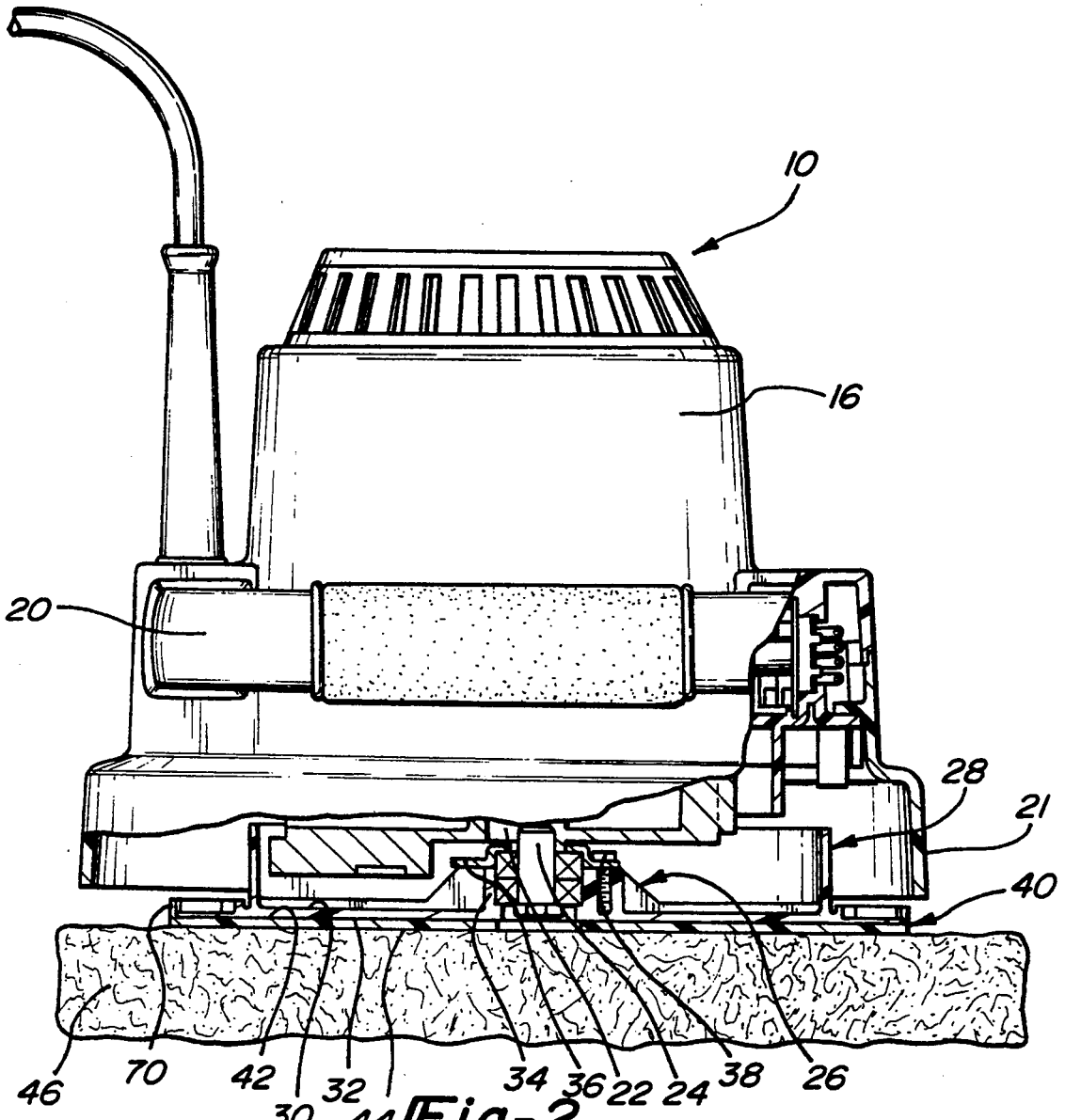
FIG. 2 is an elevation view, partially in section, of the orbital polisher of FIG. 1 and showing detail of the quick change pad assembly.

Referring to FIGS. 1 and 2, a hand-held orbital polisher is generally shown by the reference number 10 and is of the type having an electrical motor (not shown), a control device 14 for operating the motor, and a housing 16 including a pair of handles 18 and 20 close connected thereto and an annular skirt 21 disposed vertically adjacent to the surface to be polished and defining a bottom portion of the unit. In operation, the operator uses both hands to grasp the polisher handles very near to the housing whereby the thumbs of the operator's hands are readily positioned to operate the control device.

The electrical motor is mounted in the housing and has a motor shaft 22 which operates to drive a spindle 24 having a pad assembly 26 connected thereto, the spindle and motor shaft axes being vertically disposed and laterally offset, so that the spindle and pad assembly orbit about the motor shaft simultaneously as the pad assembly rotates in a horizontal plane. The details of such motor drive arrangement are known to one skilled in the art and will not be described in further detail. The output shaft and spindle project into the bottom portion to position the pad assembly 26 for rotation in the horizontal plane.

The pad assembly 26 includes a flat circular platen 28 having upper and lower endwalls 30 and 32 and a coaxial projection 34 extending vertically above the upper endwall 30 for driving connection to a spindle housing 36, such as by one or more threaded fasteners 38, and a flat circular backing plate 40 having an upper endwall 42 which abuts the endwall 32 and a lower endwall 44 to which is secured a polishing pad 46. The platen and backing plate 28 and 40 are secured together by relative manual rotation of the backing plate relative to the platen whereby a plurality of L-shaped locking lugs 48 formed on the backing plate 40 are received in a respective opening 50 in the platen 28 and then rotated into engagement with the upper endwall 30.

Figure 3:
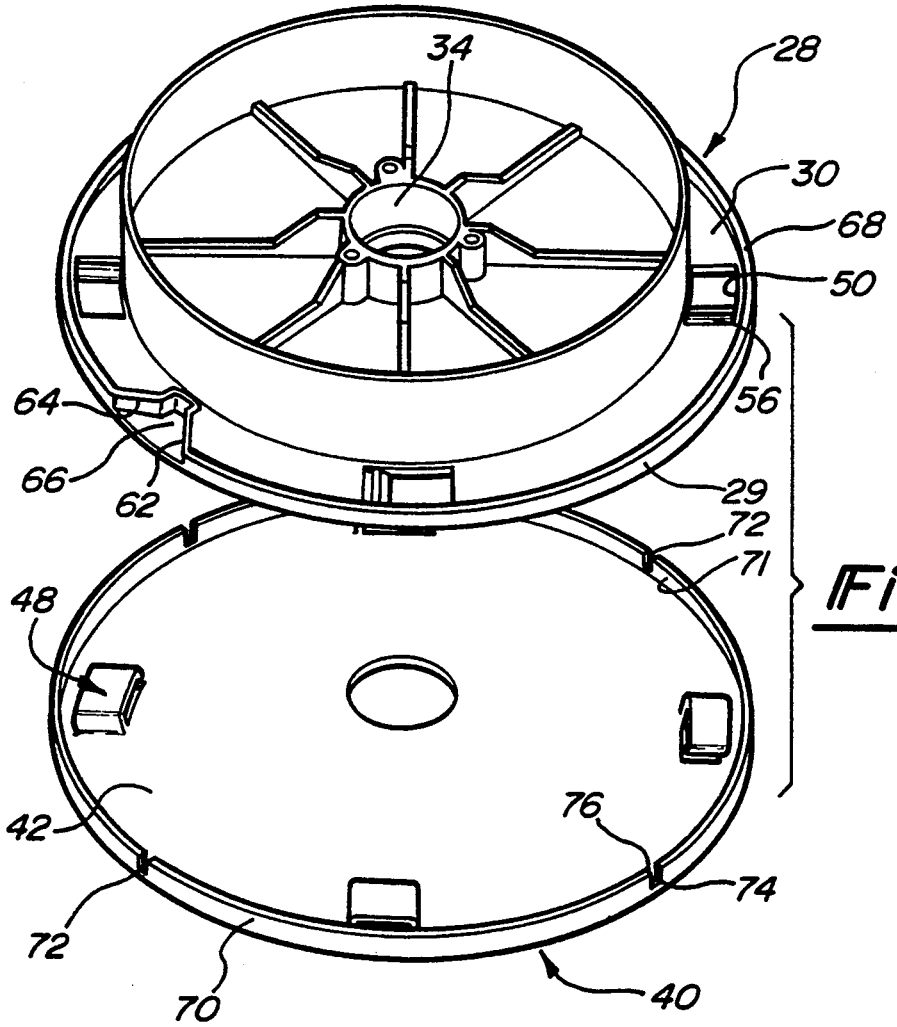
FIG. 3 is an exploded assembly view of the quick change pad assembly.
Figure 4A:
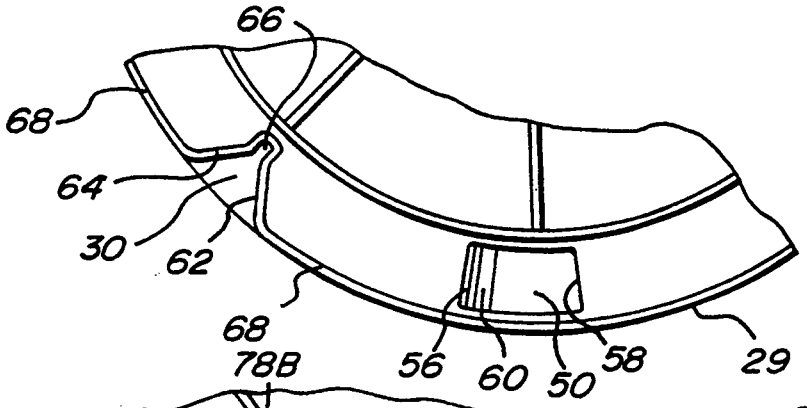
FIGS. 4A, 4B and 4C are plan views showing assembly and disassembly of the pad assembly.
Figure 4B:
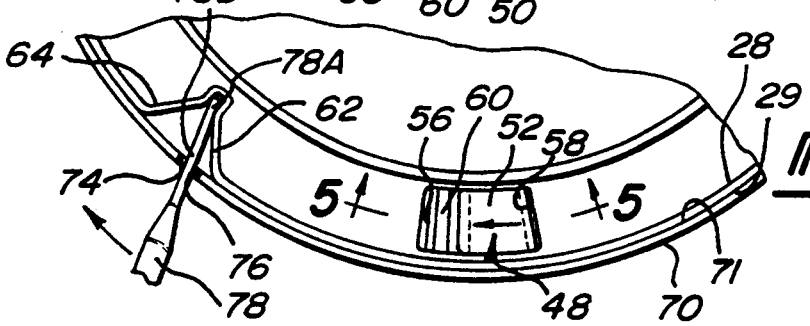
Figure 4C:
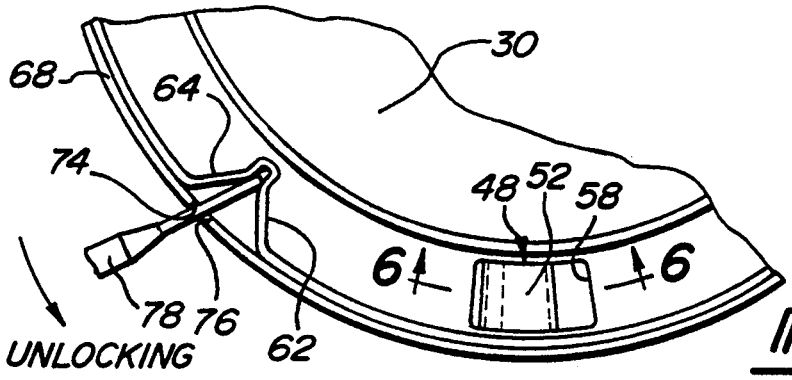
Figure 5:
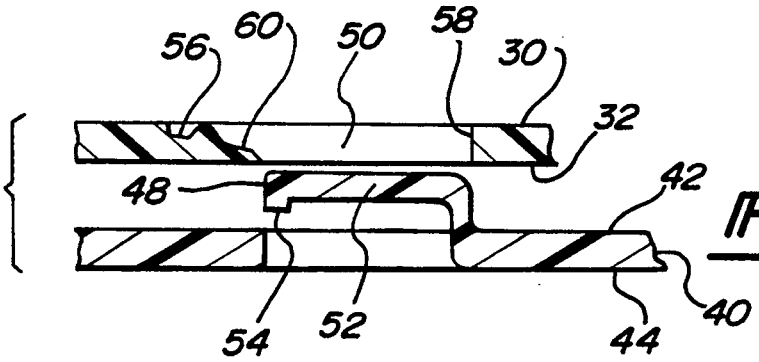
FIG. 5 is a view taken along line 5—5 of FIG. 4B.
Figure 6:
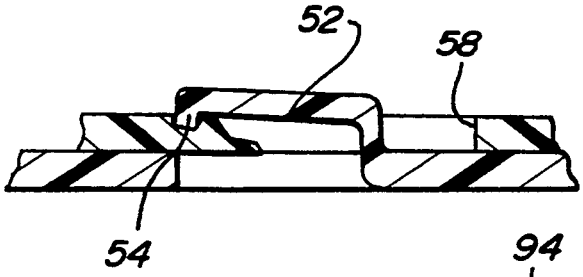
FIG. 6 is a view taken along line 6—6 of FIG. 4C.

As shown in FIGS. 3–5, four locking lugs 48 are positioned generally equiangularly around the periphery of the backing plate 40 and extend upwardly from the endwall 42 for simultaneous receipt in a corresponding lug receiving opening 50. Each lug 48 is generally L-shaped and includes a resiliently deflectable cantilever beam-like latch element 52 with the forward end portion thereof being formed with a transverse rib 54 to lockingly engage within a latch keeper defined by a transverse detent 56 formed in the endwall 30 of the platen 28.

In the exemplary embodiment shown, the lugs 48 are generally integrally formed with the backing plate, such as from a single molding operation, although their attachment could be other than shown. Further, the lugs could extend from the platen 28 and the openings could be formed in the backing plate 40.

The openings 50 are generally arcuate, have spaced endwalls 58 and 60, and are substantially identical, in plan, to the shape of the lugs, whereby the lugs are received in the openings and position the two plates for coupling engagement. The endwall 60 defines a cam to deflect the beam 52 upwardly during locking rotation and guide the latch 54 into engagement with the keeper detent 56. When engaged, the beam 52 is biased against the platen. Further, the beam length is dimensioned such that during rotation the beam can be wedged onto the platen surface 30. The keeper endwall 60 forms a cam to enhance removal of the lugs.

An important aspect of this invention resides in a manually actuated cam system whereby the two plates 28 and 40 can be easily rotated and the lugs from the plate 40 manually driven into and from locked and unlocked engagements with the platen 28. According to this aspect of the invention, a plurality of first pairs of shoulders from the platen 28 are associated with a corresponding plurality of second pairs of shoulders from the plate 40 to form first and second cam arrangements. The platen 28 is formed to include four pairs of drive shoulders 62 and 64, the shoulders of each respective pair projecting upwardly from the upper surface 30. The shoulders 62 and 64 of each respective pair of shoulders extend radially inwardly from the circumference to define a V-shaped recess and intersect one another to form a closed detent 66. An annular wall 68 extends between and connects the "leading" or first drive shoulder 62 from one shoulder pair with the "trailing" or second drive shoulder 64 of the next shoulder pair. The annular walls are formed about the circumference of the platen 28 whereby to provide rigidity to the platen and further define each of the angularly spaced V-shaped recesses.

A cylindrical wall 70 having an inner surface 71 is formed about the outer circumference of the backing plate 40, the wall 71 having a diameter slightly greater than the outer circumference 29 of the annular walls 68 formed around the platen 28. The wall 70 cooperates to rigidify the backing plate and forms a recess to receive the platen and thereby assist in positioning the plates. Importantly, openings 72 interrupt the wall 70 at four angularly separated locations corresponding to the four shoulder pairs of the platen. The opening 72 defines a pair of angularly spaced walls which form, respectively, a locking shoulder 74 in combination with a respective of the leading drive shoulders 62 and an unlocking shoulder 76 in combination with a respective of the trailing drive shoulders 64.

In operation, an operator would position the upper endwall 42 of the backing member 40 against the lower endwall 32 of the platen 28 and introduce the lugs 48 in the lug receiving openings 50, causing the openings 72 to be positioned so that each locking shoulder 74 is adjacent to a leading or first drive shoulder 62. Thereupon an elongated implement, such as a screwdriver 78, would be inserted through one of the openings 72 in the cylindrical wall 70 and into the tool receiver defined by the shoulders 62 and 64, causing the end portion 78A of the driver to be driven into the detent 66 and against the first drive shoulder 62 and a center portion 78B of the driver to abut and drive against the locking shoulder 74. The user would then apply force to the handle of the screwdriver to transmit torque to the shoulders 62 and 74 of the two platens whereby to relatively rotate the plates and simultaneously force all of the lugs in the direction of the locking detents 56 and against the endwalls 60. A fully locked relation results when the latches 54 are engaged in the latch keepers 56. Simultaneously, the unlocking shoulder 76 is rotated into position next to the second drive shoulder 64.

To disengage, the driver would be seated in the tool receiver, causing the end portion 78A of the driver to be received in the detent 66 and drive against the second drive shoulder 64 and the center portion 78B of the driver to drive against the unlocking shoulder 76. Thereupon, the operator would apply torque to the shoulders 64 and 76 to relatively rotate the platens and force the lugs away from their locked engagement with the keepers 56.

Figure 8:
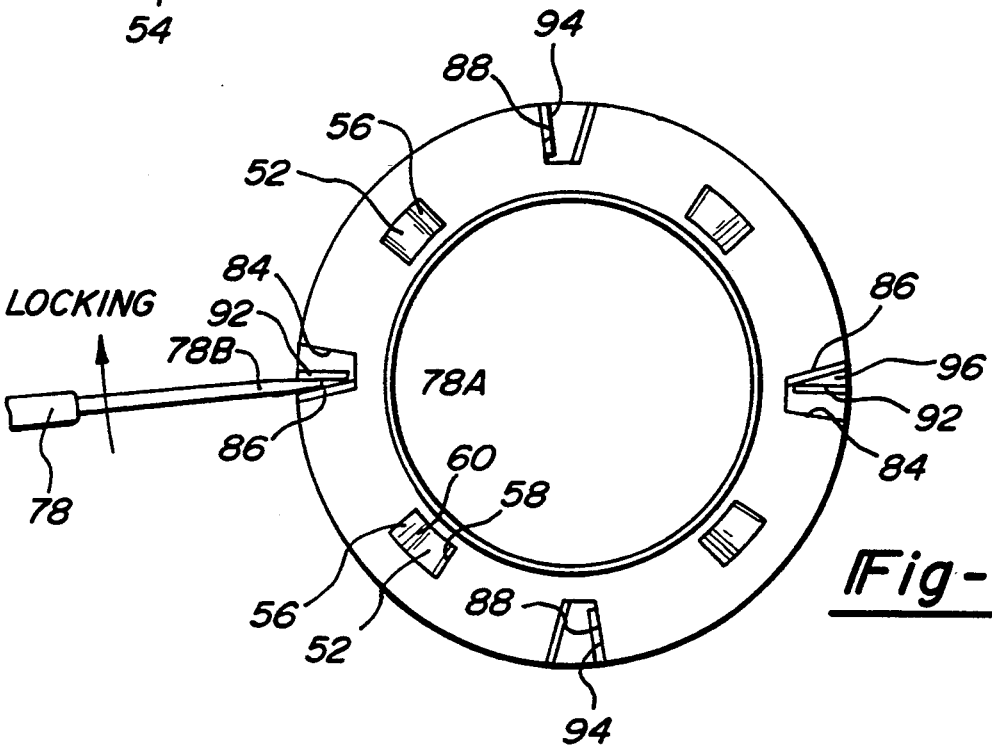
FIG. 8 is a plan view of FIG. 7 showing assembly of the modified quick change pad assembly.
Figure 7:
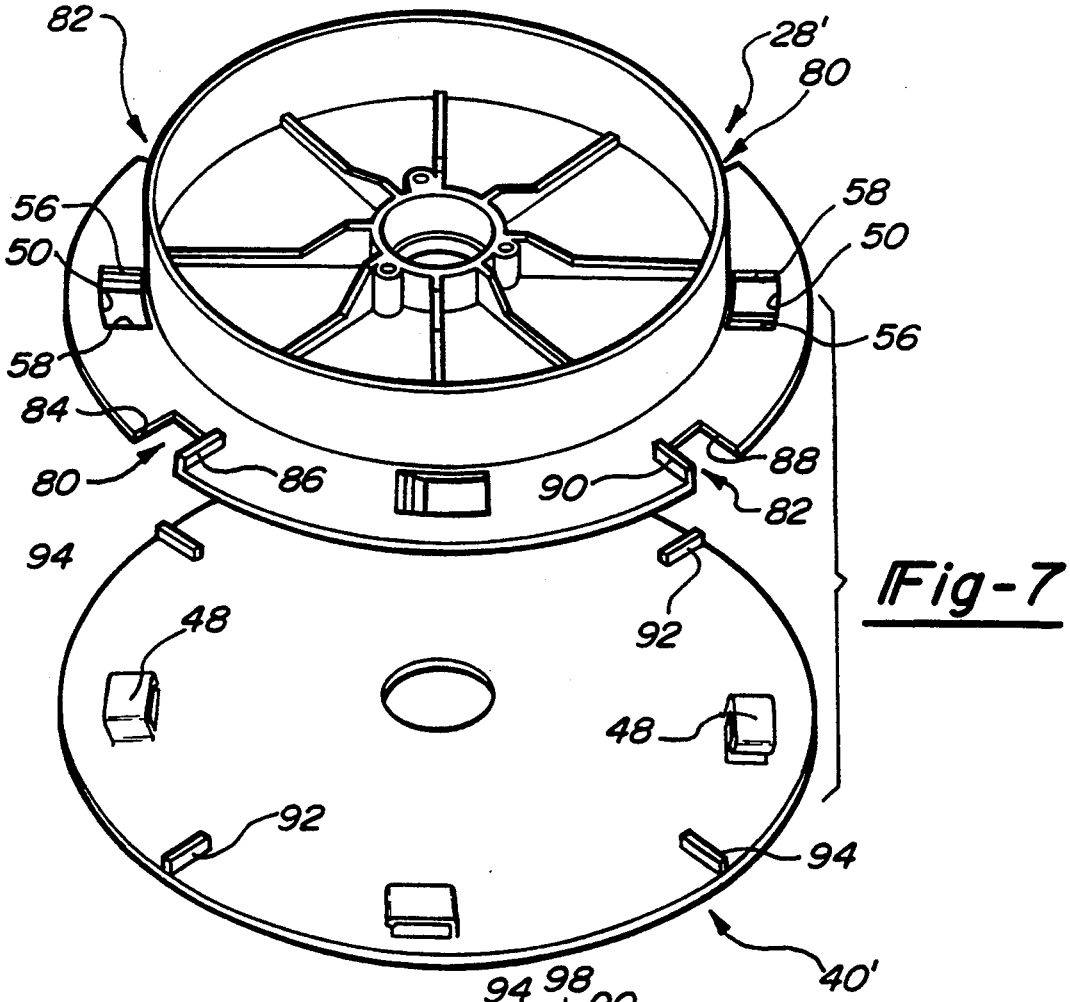
FIG. 7 is an exploded assembly view of a modified arrangement of a quick change pad assembly according to this invention.
Figure 9:
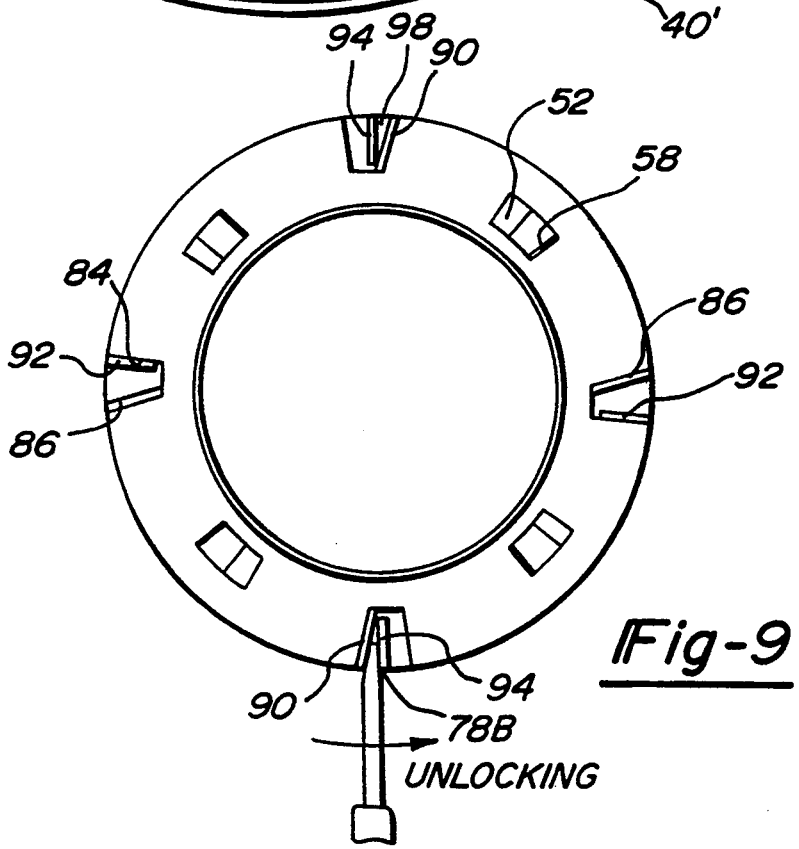
FIG. 9 is a plan view of FIG. 8 showing disassembly of the modified quick change pad assembly.

Referring to FIGS. 7–9, the manual actuating cam system according to this invention includes a drive platen 28' that connects to the drive motor and a backing plate 40' which is adapted to be rotatably coupled to the platen 28'. A set of interengaging lugs 48 and openings 50 cooperate to couple the platen and plate 28' and 40' together, in a manner as described above.

The drive platen 28' is generally flat, circular, and is formed to include a plurality of outwardly opening notches 80 and 82 around the circumference. As shown, these notches are generally equiangularly positioned with the notches 80 being diametrically opposed and defining a pair of "locking notches" and the notches 82 being diametrically opposed and defining a pair of "unlocking notches, " each notch including a pair of angularly spaced sidewalls that extend generally radially. Each locking notch 80 has a sidewall 84 that forms a limit on the rotation of the backing plate 40' and a sidewall 86 that forms a locking or drive shoulder. Similarly, each unlocking notch 82 includes a sidewall 88 which forms a limit on rotation of the backing plate and a sidewall 90 which forms an unlocking or drive shoulder.

The rotatable backing plate 40' is generally flat, circular, and is formed to include a pair of locking shoulders 92 which are positioned adjacent to the locking shoulders 86 when by the lugs 48 when the lugs are initially received in their respective openings 50 and a pair of unlocking shoulders 94 which are initially positioned against the limit sidewall 88 of an unlocking notch 82.

In operation, the platens 28' and 40' are positioned together by fitting the lugs into their respective openings. As seen in FIG. 8, the locking shoulders 92 cooperate with the shoulders 86 to form a V-shaped recess 96 for receiving the end of the tool 78 and the unlocking shoulders 94 are abutted against the limit shoulders 88. The tool 78 is inserted into the tool receiver 96 between one pair of the two locking shoulders 86 and 92. The tool is used to apply a rotative torque and cause the two plates to relatively rotate and bring the unlocking shoulder 94 of the backing plate 40' into proximity with the unlocking shoulder 90 of the platen 28' whereby the shoulders 90 and 94 form a tool receiver 98. Substantially simultaneously all of the lugs are brought into locked engagement with the detents 56 and the locking shoulders 92 abutted against the limit sidewall 84.

For disengagement, the tool is placed in the receiver 98 between the unlocking shoulders 90 and 94, rotative torque applied, and the platen rotated in the opposite direction. Substantially simultaneously with this torque, all of the lugs are disengaged.

While the above description constitutes the preferred embodiment of the invention, it will be appreciated that the invention is susceptible to modification, variation, and change without departing from the proper scope or fair meaning of the accompanying claims. For example, a plurality of cooperating locking and unlocking shoulders are illustrated. It is to be appreciated that only one locking and unlocking pair are needed. Additionally, the locking lugs could be other than shown.

What is claimed is:

1. A coupling arrangement comprising:

first and second plates forming respective first and second endwalls, said first plate being positionable relative to said second plate so that said endwalls are in substantially abutting relation and rotatable relative to said second plate between a first uncoupled position and a second position wherein said plates are secured together;

coupling means formed on said first and second plates for positioning said plates in said first uncoupled position and for securing said plates together when said first plate is rotated from said first position to said second position; and manually actuable drive means formed on said first and second plates for rotatably driving said first plate between said two positions including a first pair of shoulders, one of which extending from each of said plates, and cooperating to define a first receiver when said plates are in said first position, and a second pair of shoulders, one of which extending from each of said plates, and cooperating to define a second receiver when said plates are in said second position, said first and second receivers being adapted to receive a drive tool that is driveable against each respective shoulder pair to rotatably drive said first plate between said two positions.

2. The invention as claimed in claim 1 wherein said coupling means includes a plurality of locking lugs formed on one of said plates being adapted to interfit within a corresponding plurality of openings in the other of said plates to initially position the plates in said first position and engage the other of said plates when said first plate is driven between said first and second positions, and keepers formed in the other of said plates adjacent said openings such that said lugs interlock with said keepers to prevent unwanted uncoupling rotation of said first plate relative to said second plate while said locking lugs are in place in said second position.

3. The coupling arrangement as claimed in claim 1 wherein said manually actuable drive means includes said first plate being formed to include first and second drive shoulders and said second plate being formed to include a locking an an unlocking shoulder, said first position positioning said locking shoulder adjacent to said first drive shoulder to form said first receiver for receiving the drive tool which operates against the shoulders thereof to rotate said first plate into said secured position and rotate said unlocking shoulder adjacent to said second drive shoulder and into said second position, and said unlocking shoulder and second drive shoulder in said second position forming said second receiver for receiving the drive tool which operates against the shoulders thereof to rotate said first plate from said secured position and into the uncoupled position.

4. The coupling arrangement as claimed in claim 3 wherein said first plate is formed to include a first and second pair of diametrically disposed notches, each said notch extending radially inwardly from the outer circumference thereof and each including a pair of radial sidewalls, one and the .other of the radial sidewalls of each of said first notches forming said first drive shoulder and a first limit wall which abuts the locking shoulder in the second position, and one and the other of the sidewalls of each said second notches forming said second drive shoulder and a second limit wall which abuts the unlocking shoulder in the first position.

5. The coupling arrangement as claimed in claim 3 wherein said coupling means further includes said second plate being formed to include a cylindrical wall of a size to clearance fit about the outer circumference of said first plate, and said manually actuable drive means includes said cylindrical wall being formed to include an opening, said opening including a pair of sidewalls which define said first and second drive shoulders.

6. In an orbital polisher, drive and driven platens having interengaging lug and lug receiving openings disposed at corresponding angularly spaced locations on said platens such that said lugs extending from one of said platens register with and are received in respective openings formed in the other of said platens for coupling engagement therewith upon relative rotation between said platens, an improved coupling system for effecting engagement and disengagement of one platen with the other platen, comprising:

manually actuatable first cam means joined at angularly spaced locations to said platens and defining a first receiver for receiving a drive tool adapted for driving said first cam means to thereby rotate one of said platens relative to the other and substantially simultaneously drive said lugs from an unengaged first position to an engaged second position, and manually actuatable second cam means joined at angularly spaced locations to said platens and defining a second receiver for receiving the drive tool for driving said second cam means to thereby rotate one of said platens relative to the other and substantially simultaneously drive said lugs from said engaged second position to said disengaged first position.

7. The invention as claimed in claim 6 including locking means for locking said platens in said second position, said locking means comprising a resilient beam formed on each of said lugs that terminates in a deflectable latch and the other of said platens including a latch keeper adjacent to each of said lug receiving openings for capturing said latch when rotated relative thereto.

8. The invention as claimed in claim 6 further comprising positioning means for positioning said platens together to define said disengaged position, said positioning means comprising a pair of said lugs formed on said one platen at angularly spaced locations and a corresponding pair of said lug receiving openings formed on said other platen at respective angularly spaced locations.

9. The invention as claimed in claim 8 wherein said means further comprises a cylindrical wall extending around the periphery of one of said platens and sized to circumpose and nestingly receive the outer circumference of the other of said platens.

10. The invention as claimed in claim 9 wherein said cylindrical wall includes an interruption forming an opening having two radial sidewalls sized to receive the drive tool inserted therebetween one and the other of said sidewalls defining, respectively, a locking shoulder and an unlocking shoulder, and the other of said platens includes a first and second drive shoulder, said lugs positioning said first drive shoulder with said locking shoulder for driving abutment by the drive tool from the disengaged position to the engaged position wherein said second shoulder is positioned with said unlocking shoulder for driving abutment by the drive tool from the engaged position to the disengaged position.

11. The invention as claimed in claim 6 wherein each of said first and second cam means comprises a pair of first shoulder and a pair of second shoulders, wherein in the respective disengaged and engaged positions one of said first shoulders is spaced from and adjacent to a respective one of said second shoulders, and the other of said first shoulders is spaced from and proximate to the other of said second shoulders.

12. The invention as claimed in claim 11 wherein said first shoulders define a first and a second drive shoulder, and said second shoulders define a locking shoulder and an unlocking shoulder, said first position disposing said first shoulder adjacent to said locking shoulder and said second shoulder in spaced relation to said unlocking shoulder, and said second position disposing said first shoulder in spaced relation to said locking shoulder and said second shoulder adjacent to said unlocking shoulder.

13. A hand-held orbital polisher, comprising a housing having handle means close coupled thereto and an open bottom portion defined by an annular skirt disposed vertically, a motor carried by said housing and having a vertically disposed output shaft projecting into said bottom portion, a support platen carried by said housing and disposed within said bottom portion for rotation by said shaft in a substantially horizontal plane, a backing platen for carrying a polishing pad, interengaging lug and lug receiving openings operating upon relative rotation between the two platen for removably securing the backing platen to the support platen, and manually actuatable cam means for simultaneously driving the platen provided with the lugs into and from engagement with the platen provided with said openings, said cam means including angularly spaced first and second drive shoulders in said one platen, and angularly spaced locking and unlocking shoulders in said other platen, said lugs initially positioning said locking shoulder and said first drive shoulder in a first position and for engagement by a tool which rotates the two platen and the driving lugs into an engaged second position wherein said unlocking shoulder is in position with said second drive shoulder and for engagement by said tool for rotating said platen and driving said lugs into said first position.

14. The orbital polisher as claimed in claim 13 including an annular wall and a cylindrical wall formed, respectively, around the circumference of one and the other of said support platen and said backing platen, said cylindrical wall being positioned in a clearance fit about said annular wall and including an opening.

15. The orbital polisher as claimed in claim 13 wherein said locking and unlocking shoulders are defined by the opposing walls of the opening formed in said cylindrical wall, and said first and second drive shoulders extend radially inwardly as a continuation of said annular wall to define at least one outwardly open V-shaped throat for receiving said tool.

16. The orbital polisher as claimed in claim 13 wherein the locking shoulder and first drive shoulder are adjacent and the unlocking shoulder and second drive shoulder are spaced when in the first position, and said locking shoulder and first drive shoulder are spaced and the unlocking shoulder and second drive shoulder are adjacent when in the second position.

17. In an orbital polisher, a method of removably coupling a platen having a polishing pad to a drive platen of the orbital polisher, the steps of the method including:

forming a plurality of locking lugs at angularly spaced locations on a first of said platens, forming a corresponding plurality of lug receiving openings at corresponding angularly spaced locations on a second of said platens, forming in one of said platens at angularly spaced locations a locking shoulder and a first drive shoulder, and forming in the other of said platens at corresponding angularly spaced locations an unlocking shoulder and a second drive shoulder, such that when said locking lugs are positioned in said corresponding lug receiving openings, the locking shoulder is adjacent to said first drive shoulder and the unlocking shoulder is spaced from the second drive shoulder, applying force against the locking shoulder and first drive shoulder to substantially simultaneously rotate the platens relative to one another and move the lugs into engagement with said second of the platens, whereby the second drive shoulder is adjacent to the unlocking shoulder and the locking shoulder is spaced from the first drive shoulder, and, when removal is desired, applying force against the unlocking shoulder and second drive shoulder to substantially simultaneously rotate the platens in the opposite direction and disengage the lugs from engagement with said second of said platens and position the lugs in said first position.

* * * * *

UNITED STATES PATENT AND TRADEMARK OFFICE

CERTIFICATE OF CORRECTION

PATENT NO. : 5,347,673

DATED : September 20, 1994

INVENTOR(S) : Richard C. Nickels, Jr.

It is certified that error appears in the above-identified patent and that said Letters Patent is hereby corrected as shown below:

Column 6, line 35, claim 4, ".other" should be --other--.

Column 7, line 24, claim 9, after "said", insert --positioning--.

Column 7, line 44, claim 11, "shoulder" should be --shoulders--.

Signed and Sealed this

Twenty-seventh Day of December, 1994

*Attest:*

Bruce Lehman

BRUCE LEHMAN

*Attesting Officer*

*Commissioner of Patents and Trademarks*